US005455970A

United States Patent [19]

Vance et al.

[11] Patent Number: 5,455,970

[45] Date of Patent: Oct. 10, 1995

[54] ADJUSTABLE SHOWER AND RAIN CAP

[76] Inventors: Ricardo B. Vance; Helen Valere, both of 8400 Shorefront Pky., Rockaway Beach, N.Y. 11693

[21] Appl. No.: 263,733

[22] Filed: Jun. 22, 1994

[51] Int. Cl.[6] ..... A42B 1/22

[52] U.S. Cl. ..... 2/171.04; 2/171; 2/209.11; 2/417

[58] Field of Search ..... 2/171, 171.03, 2/171.04, 174, 175.1, 68, 195.1, 195.2, 195.3, 195.4, 209.11, 417, 419, 183, 209.12

[56] References Cited

U.S. PATENT DOCUMENTS 3,237,210 3/1966 Graber ..... 2/209.11

3,268,913 8/1966 Gettinger ..... 2/171

4,937,885 7/1990 Gregg ..... 2/171

FOREIGN PATENT DOCUMENTS 486220 5/1992 European Pat. Off. ..... 2/68

*Primary Examiner*—Clifford D. Crowder
*Assistant Examiner*—Diana L. Biefeld
*Attorney, Agent, or Firm*—Michael I. Kroll

[57] ABSTRACT

An adjustable shower and rain cap is provided, which consists of a headband worn about a head of a person. A waterproof pliable crown is affixed to the headband, so as to extend over the head of the person at different changeable heights. A structure is for retaining the crown in any one of the different changeable heights, so that the crown can cover any one of a number of different types of hairdos and keep it dry.

9 Claims, 2 Drawing Sheets

ADJUSTABLE SHOWER AND RAIN CAP

BACKGROUND OF THE INVENTION

1. Field of the Invention

The instant invention relates generally to hats and more specifically it relates to an adjustable shower and rain cap.

2. Description of the Prior Art

Numerous hats have been provided in prior art that are each a covering for the head of a person, usually with a shaped crown and brim which is worn over the hair on the head of the person. While these units may be suitable for the particular purpose to which they address, they would not be as suitable for the purposes of the present invention as heretofore described.

SUMMARY OF THE INVENTION

A primary object of the present invention is to provide an adjustable shower and rain cap that will overcome the shortcomings of the prior art devices.

Another object is to provide an adjustable shower and rain cap that can be shaped to fit onto various sized heads and cover different types of hairdos.

An additional object is to provide an adjustable shower and rain cap, in which the crown of the cap is fabricated out of waterproof pliable material that can be folded over and held in place by fasteners attached in spaced apart rows thereto.

A further object is to provide an adjustable shower and rain cap that is simple and easy to use.

A still further object is to provide an adjustable shower and rain cap that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
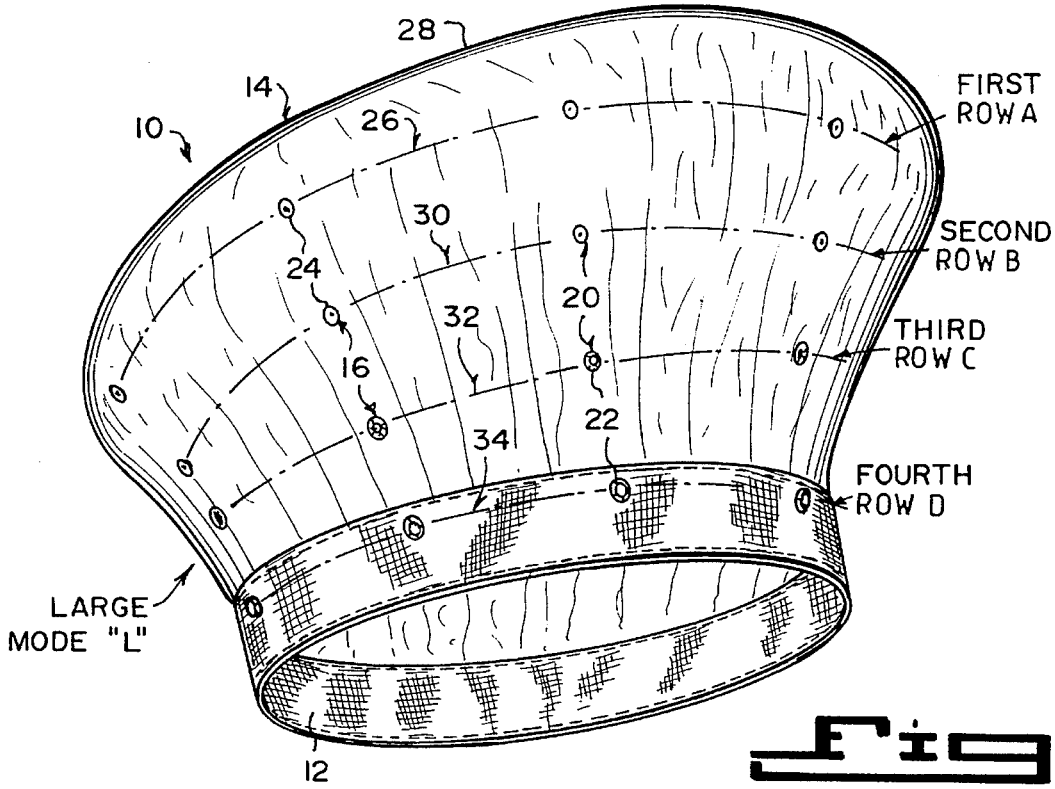
FIG. 1 is a perspective view of the instant invention in a large mode.

Turning now descriptively to the drawings, in which similar reference characters denote similar elements throughout the several views, FIGS. 1 through 6 illustrate an adjustable shower and rain cap 10, which consists of a headband 12 worn about a head of a person. A waterproof pliable crown 14 is affixed to the headband 12, so as to extend over the head of the person at different changeable heights. A structure 16 is for retaining the crown 14 in any one of the different changeable heights, so that the crown 14 can cover any one of a number of different types of hairdos and keep it dry.

The headband 12 is fabricated out of elastic material 18, so that the headband 12 will fit onto various sized heads. The waterproof pliable crown 14 is made into the different changeable heights by folding over a portion thereof, to go from a large mode "L" shown in FIG. 1 for a high hairdo, to a medium mode "M" shown in FIGS. 2 and 3 for a regular hairdo and then to a small mode "S" shown in FIGS. 4, 5 and 6 for a short hairdo on the head of the person.

The retaining structure 16 is a plurality of snap fasteners 20, in which parts of the snap fasteners 20 are arranged in a pattern onto the crown 14 and the headband 12. The parts of each snap fastener 20 is a female socket 22 and a male plug 24. The male plug 24 is received into and held within the female socket 22 when so applied.

The pattern of the parts of the snap fasteners 20, as best seen in FIG. 1, includes a first row 26 of a plurality of the male plugs 24 affixed to the crown 14 in spaced apart relationships, below the top 28. A second row 30 of a plurality of the male plugs 24 are affixed to the crown 14 in spaced apart relationships below the first row 26 of the male plugs 24. A third row 32 of a plurality of the female sockets 22 are affixed to the crown 14 in spaced apart relationships below the second row 30 of the male plugs 24. A fourth row 34 of a plurality of the female sockets 22 are affixed to the headband 12 below the third row 32 of the female sockets 22.

Figure 2:
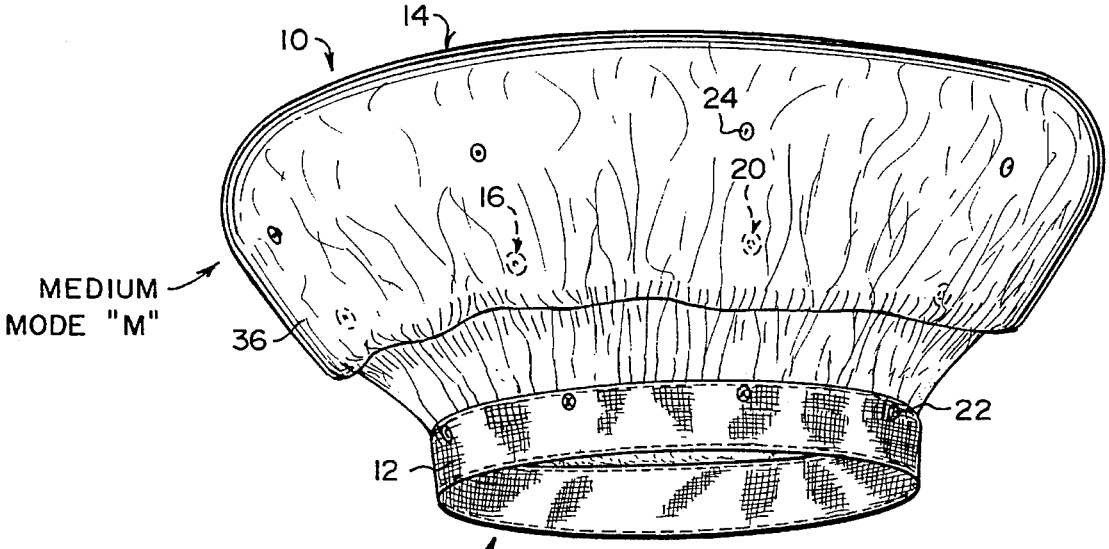
FIG. 2 is a perspective view of the instant invention in a medium mode.
Figure 3:
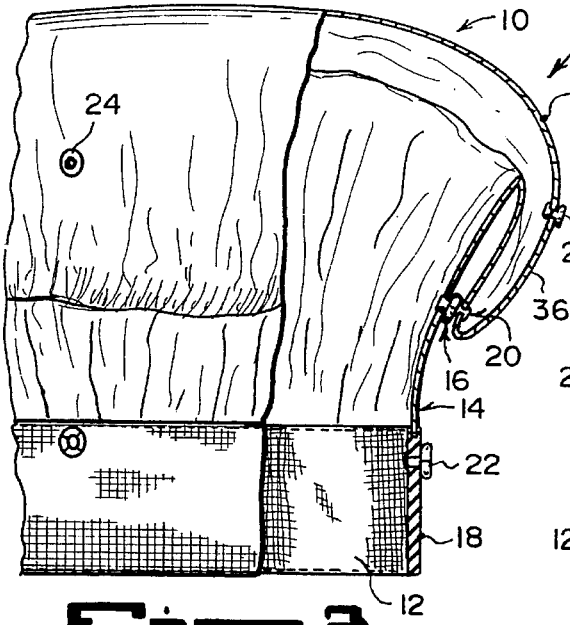
FIG. 3 is an elevational view of a portion of the instant invention in the medium mode, with parts broken away and in section.
Figure 6:
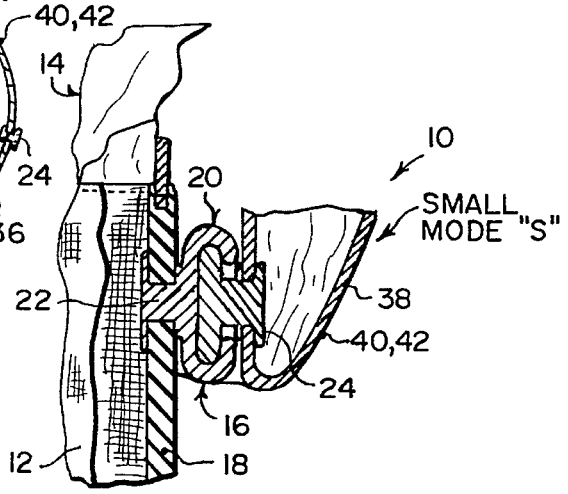
FIG. 6 is an enlarged detail view as indicated by arrow 6 in FIG. 5, showing the retaining structure of one female socket in engagement with one male plug.
Figure 4:
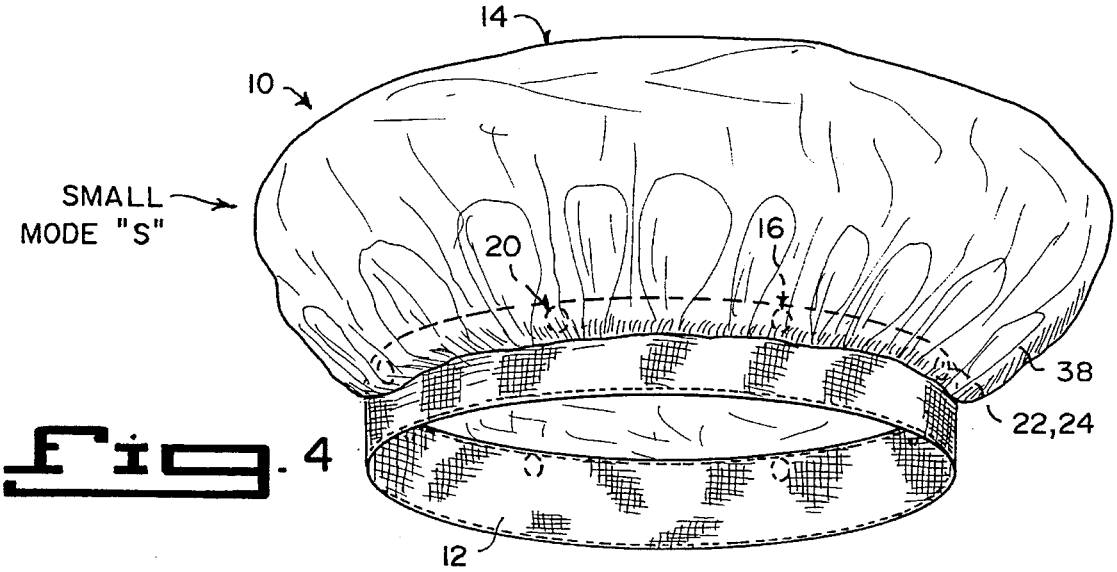
FIG. 4 is a perspective view of the instant invention in a small mode.
Figure 5:
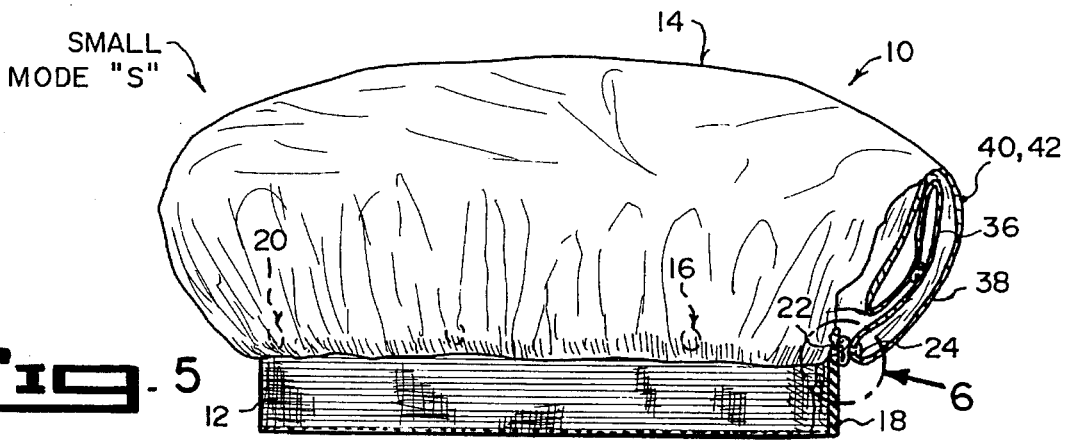
FIG. 5 is an elevational view of the instant invention in the small mode, with parts broken away and in section.

The large mode "L" is made by the crown 14 being completely unfolded above the headband 12, as shown in FIG. 1. The medium mode "M" is made and retained by making a first fold 36 in the crown 14, so that the second row 30 of the male plugs 24 will be received into and held within the third row 32 of the female sockets 22, as shown in FIGS. 2 and 3. The short mode "S" is made and retained by making a second fold 38 in the crown 14, so that the first row 26 of the male plugs 24 will be received into and held within the forth row 34 of the female sockets 22, as shown in FIGS. 4, 5 and 6.

The crown 14 can be fabricated out of a thin flexible plastic sheet 40. The crown 14 can also be fabricated out of a water repellent fabric 42. Other types of materials can be utilized, such as wool, nylon, cotton, acrylic and polyvinylchloride. The materials can be of all synthetics and man made fibers. Anything non-metallic and autonomous materials can also be used for the crown 14.

Figure 7:
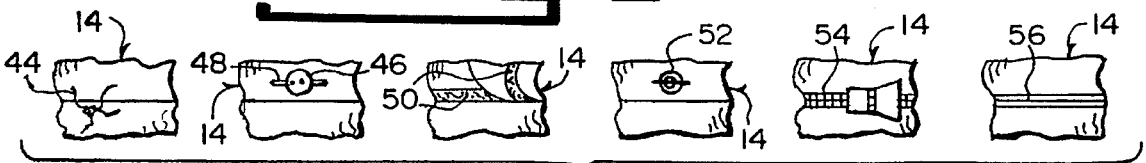
FIG. 7 shows detail views of other types of retaining structures that can be utilized in the instant invention.

FIG. 7 shows other types of retaining structures 16 that can be used in place of the snap fasteners 20 illustrated in FIGS. 1 through 6. The retaining structures 16 can be laces 44, buttons 46 and button holes 48, VELCRO hook and loop fastener strips 50, eyelet fasteners 52, zippers 54 and ziplock fasteners 56 arranged in the same pattern as the snap fasteners 20 onto the crown 14 and the headband 12.

OPERATION OF THE INVENTION

To use the adjustable shower and rain cap 10 in FIGS. 1 through 6, the following steps should be taken:

1. For the large mode "L", simply place the headband 12 about the head of the person.
2. The crown 14 will be completely unfolded to cover the high hairdo of the person.
3. For the medium mode "M", make the first fold 36 in the crown 14.
4. Attach the male plugs 24 in the second row 30, to the female sockets 22 in the third row 32.
5. Place the headband 12 about the head of the person.
6. The crown 14 will now cover the regular hairdo of the person.
7. For the small mode "S", follow steps 3 and 4.
8. Make the second fold 38 over the first fold 36 in the crown 14.
9. Attach the male plugs 24 in the first row 26 to the female sockets 22 in the fourth row 34 on the headband 12.
10. Place the headband 12 about the head of the person.
11. The crown 14 will now cover the short hairdo of the person.

LIST OF REFERENCE NUMBERS

10 adjustable shower and rain cap
12 headband of 10
14 waterproof pliable crown of 10
16 retaining structure of 10
18 elastic material of 12
20 snap fastener of 16
22 female socket of 20
24 male plug of 20
26 first row of 24 on 14
28 top of 14
30 second row of 24 on 14
32 third row of 22 on 14
34 fourth row of 22 on 12
36 first fold in 14
38 second fold in 14
40 thin flexible plastic sheet for 14
42 water repellent fabric for 14
44 lace
46 button
48 button hole
50 VELCRO hook and loop fastener strip
52 eyelet fastener
54 zipper
56 ziplock fastener
L large mode for 10
M medium mode for 10
S small mode for 10

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An adjustable shower and rain cap which comprises:

a) a headband worn about a head of a person, said headband being fabricated out of elastic material, so that said headband will fit onto various sized heads;

b) a waterproof pliable crown affixed to said headband, so as to extend over the head of a person at different changeable heights, said waterproof pliable crown being made into the different changeable heights by folding over a portion thereof to go from a large mode for a high hairdo, to a medium mode for a regular hairdo and then to a small mode for a short hairdo, on the head of a person; and c) means for retaining said crown in any one of the different changeable heights, so that said crown can cover any one of a number of different types of hairdos and keep it dry, said retaining means including a plurality of snap fasteners, in which parts of said snaps fasteners are arranged in a pattern onto said crown and said headband, said parts of each said snap fasteners including a female socket and a male plug, whereby said male plug is received into and held within said female socket when so applied, the pattern of said parts of said snap fasteners including a first row of a plurality of said male plugs affixed to said crown in spaced apart relationships below the top, a second row of a plurality of said male plugs affixed to said crown in spaced apart relationships below said first row of said male plugs, a third row of a plurality of said female sockets affixed to said crown in spaced apart relationships below said second row of said male plugs, and a fourth row of a plurality of said female sockets affixed to said headband below said third row of said female sockets.

2. An adjustable shower and rain cap as recited in claim 1, wherein said large mode is made by said crown being completely unfolded above said headband.

3. An adjustable shower and rain cap as recited in claim 2, wherein said medium mode is made and retained by making a first fold in said crown, so that said second row of said male plugs will be received into and held within said third row of said female sockets.

4. An adjustable shower and rain cap as recited in claim 3, wherein said short mode is made and retained by making a second fold in said crown, so that said first row of said male plugs will be received into and held within said forth row of said female sockets.

5. An adjustable shower and rain cap as recited in claim 4, wherein said crown is fabricated out of a thin flexible plastic sheet.

6. An adjustable shower and rain cap as recited in claim 4, wherein said crown is fabricated out of a water repellent fabric.

7. An adjustable shower and rain cap as recited in claim 1, wherein said retaining means includes a plurality of buttons and button holes, in which said buttons and button holes are arranged in a pattern onto said crown and said headband.

8. An adjustable shower and rain cap as recited in claim 1, wherein said retaining means includes a plurality of hook and loop fastener strips, in which said hook and loop fastener strips are arranged in a pattern onto said crown and said headband.

9. An adjustable shower and rain cap as recited in claim 1, wherein said retaining means includes a plurality of eyelet fasteners, in which said eyelet fasteners are arranged in a pattern onto said crown and said headband.

* * * * *